US011577174B2

(12) United States Patent
Storm

(10) Patent No.: US 11,577,174 B2
(45) Date of Patent: Feb. 14, 2023

(54) TOY VEHICLE CONTROL MECHANISM FOR PERFORMING STUNTS

(71) Applicant: Allan Henry Storm, Boerne, TX (US)

(72) Inventor: Allan Henry Storm, Boerne, TX (US)

( * ) Notice: Subject to any disclaimer, the term of this patent is extended or adjusted under 35 U.S.C. 154(b) by 0 days.

(21) Appl. No.: 16/863,374

(22) Filed: Apr. 30, 2020

(65) Prior Publication Data

US 2020/0346125 A1 Nov. 5, 2020

Related U.S. Application Data

(60) Provisional application No. 62/842,769, filed on May 3, 2019.

(51) Int. Cl.

| | |
|---|---|
| ***A63H 17/00*** | (2006.01) |
| ***A63H 33/00*** | (2006.01) |
| ***A63H 33/02*** | (2006.01) |
| ***A63H 17/36*** | (2006.01) |
| ***A63H 30/04*** | (2006.01) |
| ***A63H 17/28*** | (2006.01) |
| ***A63H 17/32*** | (2006.01) |
| ***A63H 17/26*** | (2006.01) |

(52) U.S. Cl.

CPC ..... *A63H 17/36* (2013.01); *A63H 17/004* (2013.01); *A63H 17/268* (2013.01); *A63H 17/28* (2013.01); *A63H 17/32* (2013.01); *A63H 30/04* (2013.01); *A63H 33/007* (2013.01); *A63H 33/02* (2013.01)

(58) Field of Classification Search

CPC .... A63H 17/004; A63H 17/268; A63H 17/28; A63H 17/32; A63H 17/36; A63H 17/38; A63H 33/00; A63H 33/007; A63H 33/02; A63H 27/002; A63H 27/04; A63F 2250/485; A63B 67/086; G09F 21/00

See application file for complete search history.

(56) References Cited

U.S. PATENT DOCUMENTS

| | | | | |
|---|---|---|---|---|
| 1,996,546 A | | 4/1934 | Lindberg | |
| 2,216,497 A | | 10/1940 | McHenry | |
| 2,260,679 A | | 10/1941 | Neilson | |
| 2,501,206 A | * | 3/1950 | Brackett, Jr. ..... | A63H 17/38 446/451 |
| 2,584,561 A | | 2/1952 | Denny | |
| 2,642,700 A | | 6/1953 | Zimmer | |
| 2,651,882 A | | 9/1953 | Core | |
| 2,699,011 A | | 1/1955 | Sedgwick | |
| 2,730,837 A | | 1/1956 | Vaughan | |
| 2,739,416 A | | 3/1956 | Sterling | |
| 3,043,052 A | | 7/1962 | Stanzel | |
| 3,590,526 A | | 7/1971 | Deyerl | |
| 3,604,149 A | * | 9/1971 | Salontai ..... | A63H 33/02 273/126 R |

(Continued)

*Primary Examiner* — Eugene L Kim
*Assistant Examiner* — Alyssa M Hylinski

(57) ABSTRACT

A toy vehicle control mechanism for performing stunts includes a rod coupled to a connection piece that permits a user to selectively manipulate a toy vehicle. The rod includes a rod-tip and a shaft, and the connection piece is formed as a loop or arch shaped structure that is secured to a toy vehicle as an interface for the rod-tip. The rod-tip has an interior opening and an exterior notch with a solid section separating the notch from the opening. The rod-tip and connection piece are configured so that the connection piece can travel around within the opening and be manipulated by selectively engaging the rod-tip's notch with various portions of the connection piece.

14 Claims, 19 Drawing Sheets

(56) References Cited

U.S. PATENT DOCUMENTS 3,748,778 A * 7/1973 Ellies ..... A63H 33/067 446/106
3,762,096 A 10/1973 Reyes
3,826,038 A 7/1974 Gentilini
3,827,180 A * 8/1974 Phillips, Jr. ..... A63H 33/02 446/450
4,007,646 A 2/1977 De Jonge
4,187,637 A 2/1980 Nielsen
4,317,307 A 3/1982 Conry
4,595,380 A 6/1986 Magers
4,765,636 A 8/1988 Speer
5,217,240 A * 6/1993 Gardenhour, Jr. ..... B62H 7/00 280/282
5,240,451 A 8/1993 Clark
5,288,262 A * 2/1994 Phillips ..... A63H 33/02 446/412
5,683,250 A * 11/1997 Paivanas ..... G09B 19/165 446/32
5,730,639 A 3/1998 Harding
D394,091 S * 5/1998 Parry ..... D21/486
5,803,782 A * 9/1998 Selton ..... A47B 47/005 446/125
6,135,479 A * 10/2000 Tibay ..... B62H 7/00 280/282
6,272,946 B1 8/2001 Roux
6,488,563 B1 12/2002 Isaacson
6,569,041 B1 * 5/2003 Riivald ..... A63B 69/3667 473/446
7,241,197 B2 7/2007 De Oliveira
7,371,146 B2 * 5/2008 Scarborough ..... A63H 33/084 446/124
7,442,109 B2 10/2008 Fosbenner
8,894,463 B2 11/2014 Chan
2006/0154726 A1 * 7/2006 Weston ..... A63F 13/12 463/36
2009/0149110 A1 * 6/2009 Scarborough ..... A63H 33/084 446/120
2018/0033351 A1 * 2/2018 Chou ..... B60R 13/00

* cited by examiner

TOY VEHICLE CONTROL MECHANISM FOR PERFORMING STUNTS

CROSS-REFERENCE TO RELATED APPLICATIONS

This application relates to, and claims the priority to the filing date of, U.S. provisional patent application Ser. No. 62/842,769 entitled MINIATURE TOY VEHICLE CONTROL MECHANISM FOR PERFORMING STUNTS, filed May 3, 2019, the entire contents of which are incorporated herein by reference for all purposes.

BACKGROUND OF THE INVENTION

Many children and adults enjoy playing with toy vehicles. Most toy vehicles are relatively inexpensive and built to be manually controlled through pushing and/or pulling, by hand or at the end of a string or a stick with minimal control or direction. The manually-controlled toy vehicles on the market today have limited play value because their inability to simulate realistic stunts often performed by full-scale vehicles. Consequently, the users of these vehicles often lose interest with them after a short period of time.

Radio-controlled toy vehicles provide better control and are capable of performing realistic stunts. However, radio-controlled toy vehicles are expensive and difficult for some users; especially when attempting stunts. Also, radio-controlled toy vehicles easily break when they are crashed. This often results in the radio-controlled toy vehicle being thrown away or needing costly repairs. Thus, radio-controlled toy vehicles also have a limited play value.

SUMMARY OF THE INVENTION

The present invention provides a control mechanism to enhance the play value of a toy vehicle by improving its maneuverability and realism. The control mechanism will provide the user a means to manually propel and steer the toy vehicle without the need for a user's hand or other appendage to be physically on the vehicle. The control mechanism will also provide the user the ability to easily perform flips, aerial maneuvers, and other stunts often displayed by full-scale vehicles; also without the need for a user's hand or other appendage to be physically on the vehicle. Additionally, it is foreseen that this invention may also be beneficial to:

- Adults and children who find it difficult to operate or are unable to operate toy vehicles or other types of toys due to an undesirable play area and/or the user's physical limitations.
- Drivers, athletes or other performers who use the control mechanism to practice stunts that may cross over into their sport or field of performance.

DETAILED DESCRIPTION OF THE INVENTION

Figure 4:
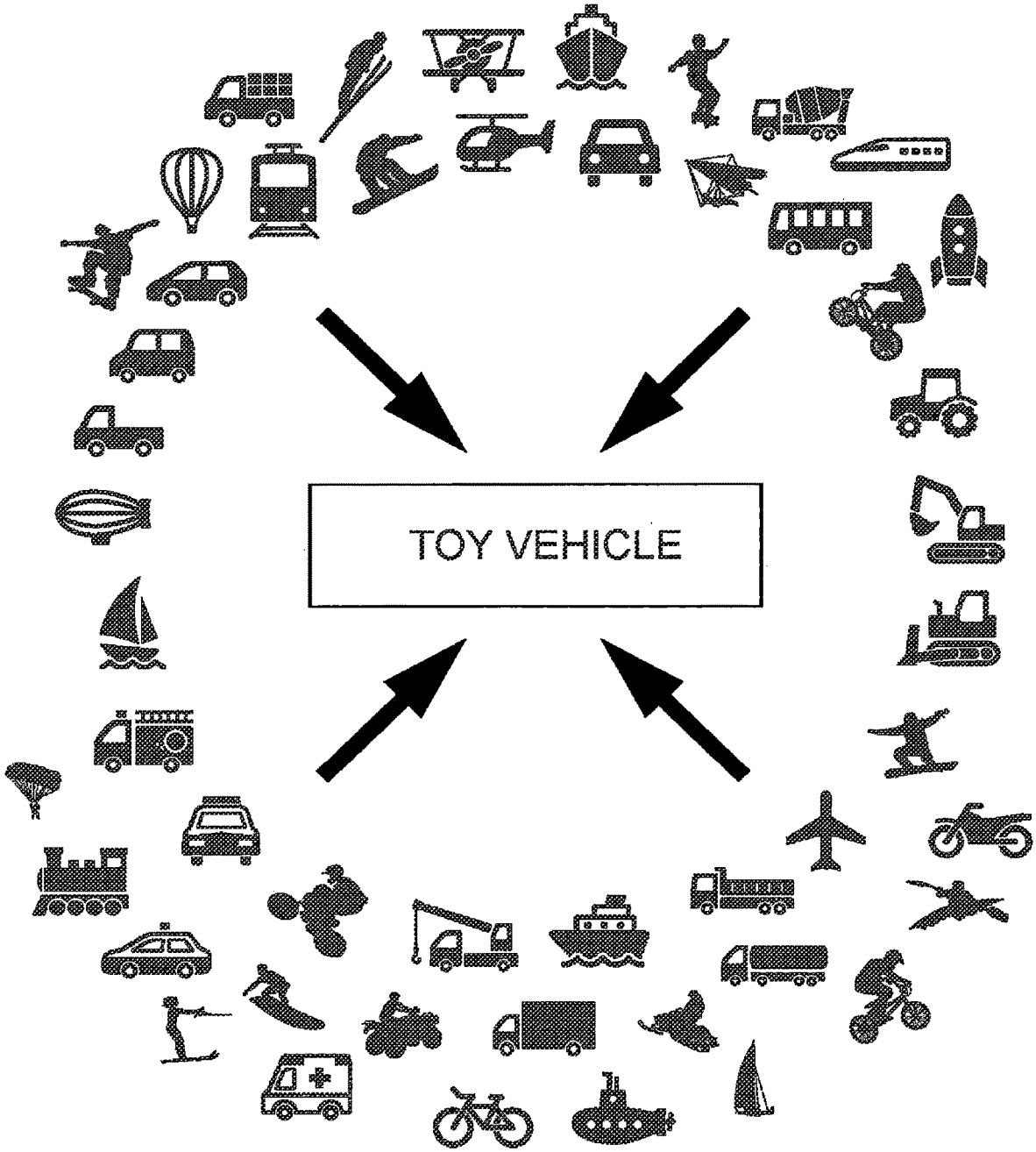
FIG. 4 illustrates examples of what could be a toy vehicle. The large rectangle represents a toy vehicle; more specifically it's a side view perspective of a toy vehicle as specified in FIG. 5 and FIG. 6.
Figure 5:
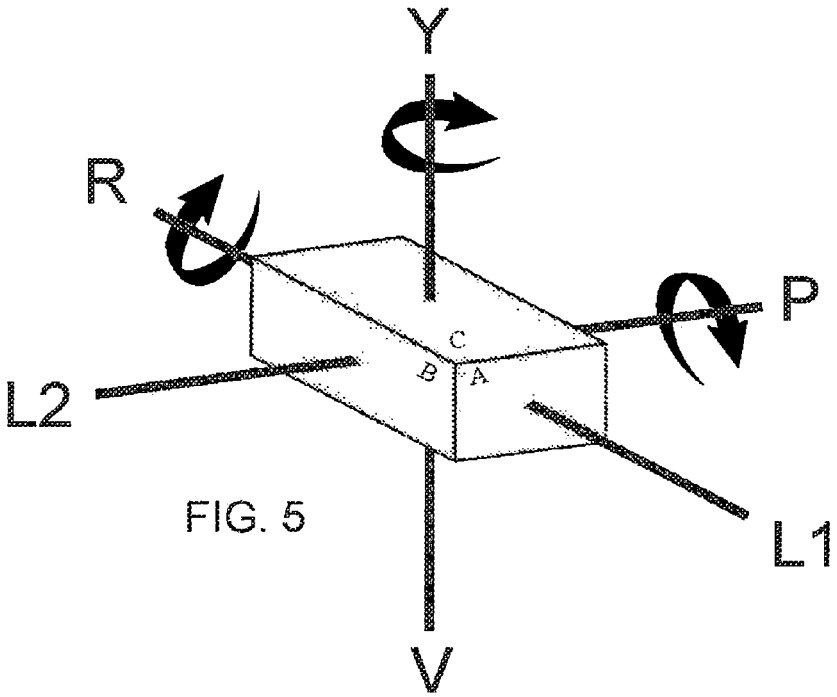
FIG. 5 illustrates the three axes of rotation on a toy vehicle. The three-dimensional rectangle represents the toy vehicle. The three imaginary axes are referred to herein as longitudinal L1, lateral L2 and vertical V. The axis intersection points will vary depending on the toy vehicle's characteristics and the control mechanism's position and usage. Motion around the longitudinal axis, the lateral axis and the vertical axis are referred to as roll R, pitch P and yaw Y, respectively. Additionally, the toy vehicle's perspectives are labeled as A for end view, B for side view, and C for top view.
Figure 6:
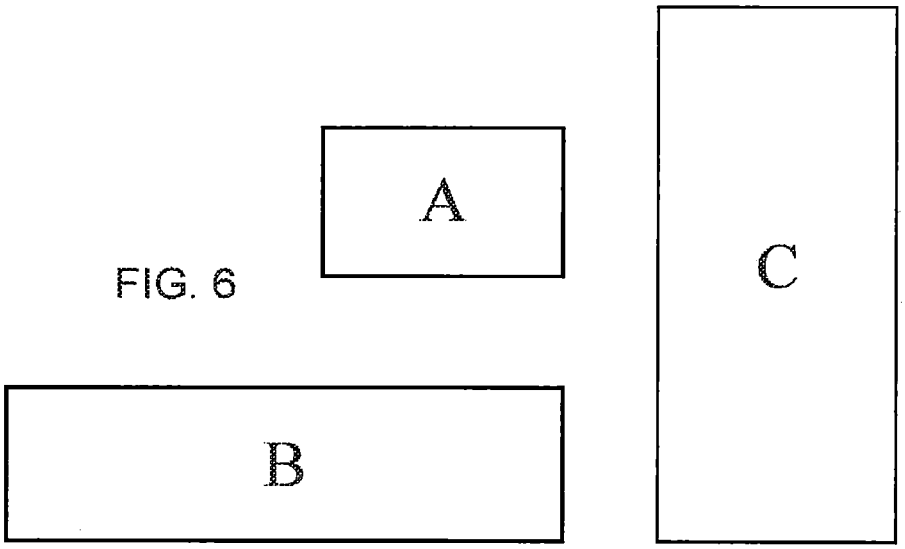
FIG. 6 illustrates the different sized rectangles to indicate a toy vehicle's end view A, side view B, or top view C of a toy vehicle.
Figure 7:
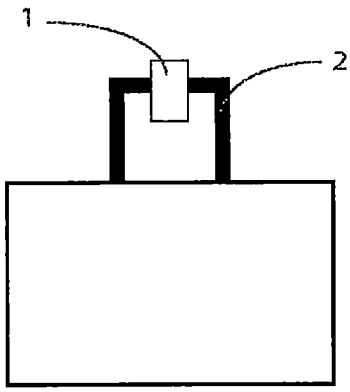
FIG. 7 illustrates an end view of a toy vehicle with the rod coupled to the connection piece when the rod is parallel or longitudinal with the toy vehicle.
Figure 8:
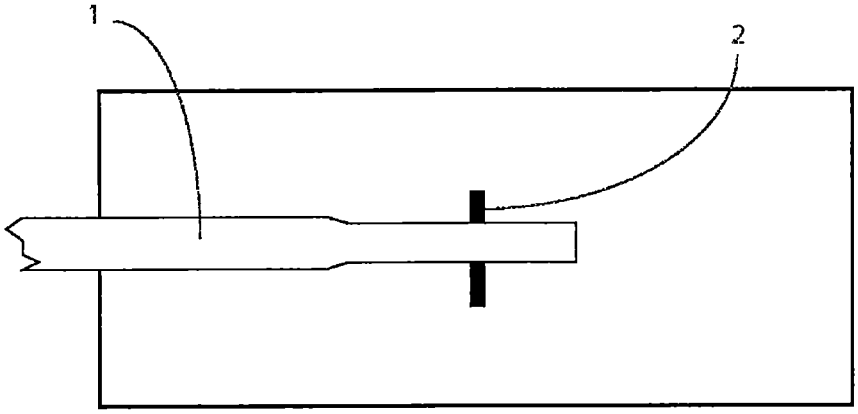
FIG. 8 illustrates the top view of a tov vehicle with the rod coupled to the connection piece when the rod is parallel or longitudinal with the toy vehicle.
Figure 9:
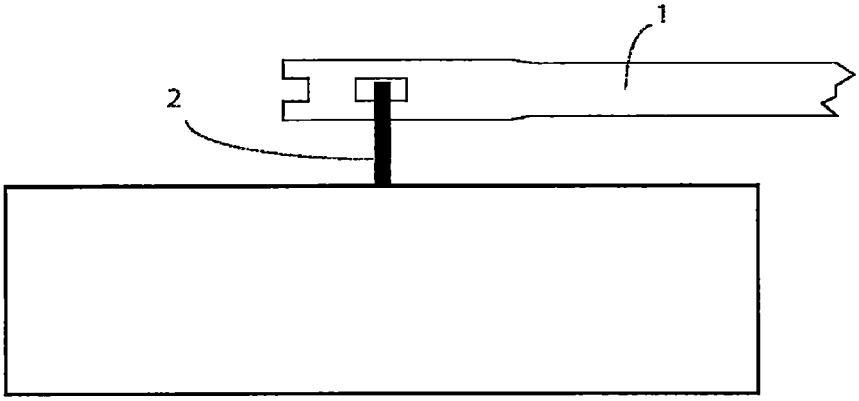
FIG. 9 illustrates a side view of a toy vehicle with the rod coupled to the connection piece when the rod is parallel or longitudinal with the toy vehicle.
Figure 10:
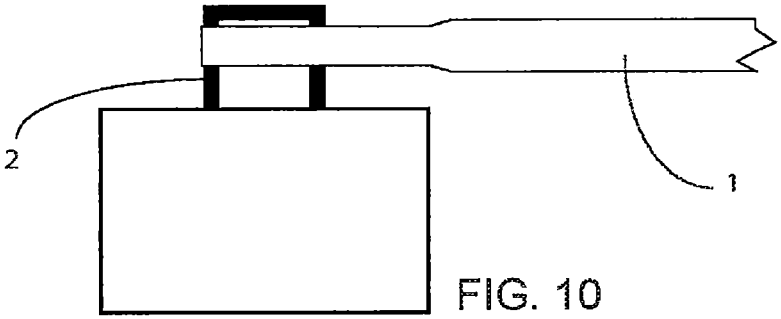
FIG. 10 illustrates an end view of a toy vehicle with the rod coupled to the connection piece when the rod is perpendicular or lateral with the toy vehicle.
Figure 11:
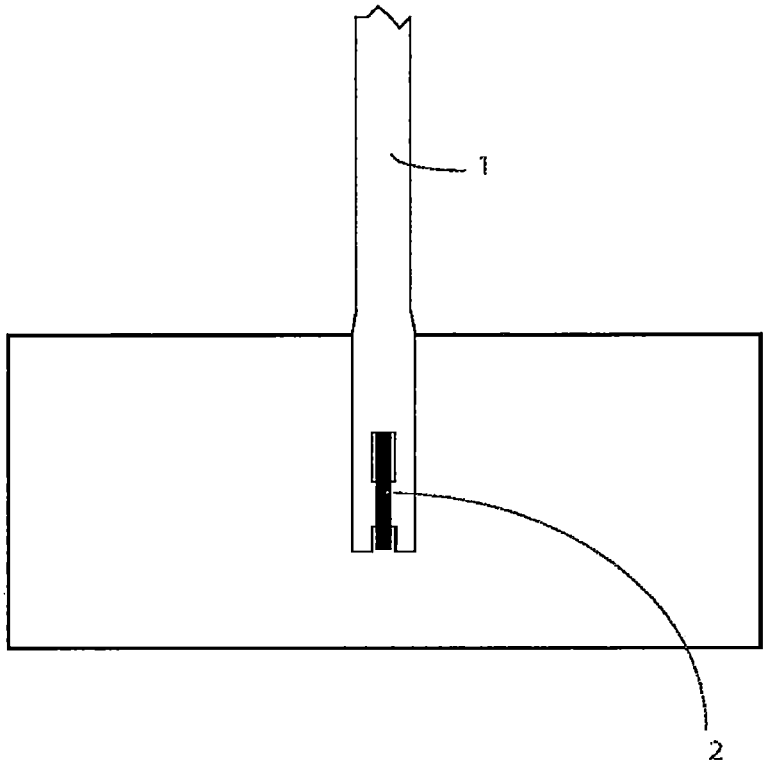
FIG. 11 illustrates the top view of a toy vehicle with the rod coupled to the connection piece when the rod is perpendicular or lateral with the toy vehicle.
Figure 12:
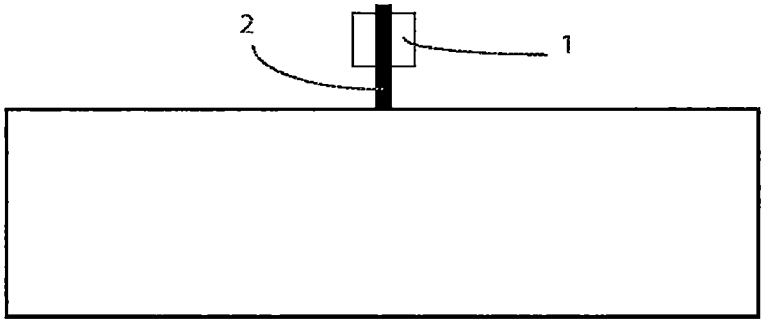
FIG. 12 illustrates a side view of a toy vehicle with the rod coupled to the connection piece when the rod is perpendicular or lateral with the toy vehicle.

This invention relates to a control mechanism or combination of those control mechanisms for a toy vehicle that allows the user to not only propel and steer the toy vehicle, but also perform stunts with the toy vehicle, such as: flips, twists, and rolls. However, a stunt could be any movement, maneuver or trick performed by a user of a vehicle. Toy vehicles are small-scale mobile devices meant to simulate the looks and/or operation of full-scale vehicles that were designed to operate either on land, in water, in air, or in outer space, or any combination thereof. A vehicle could also mean other human conveyances that are typically ridden on, including skateboards, snowboards, snow skis, and surfboards. Additionally, it is foreseeable that this control mechanism could be used on other types of toys. FIG. 4 shows examples of what could be a toy vehicle. In this description of the invention, the large rectangles illustrated in the drawings, and resembling the rectangles in FIG. 6, shall represent a toy vehicle. Furthermore, FIG. 5 illustrates a toy vehicle's longitudinal axis L1, lateral axis L2, and vertical axis V. A toy vehicle may include associated accessories, including a toy figure, that a control mechanism may be attached to. In this description of the invention, the term "including" means "including but not limited to". Additionally, a toy vehicle may be referred as a vehicle or a toy.

Figure 1:
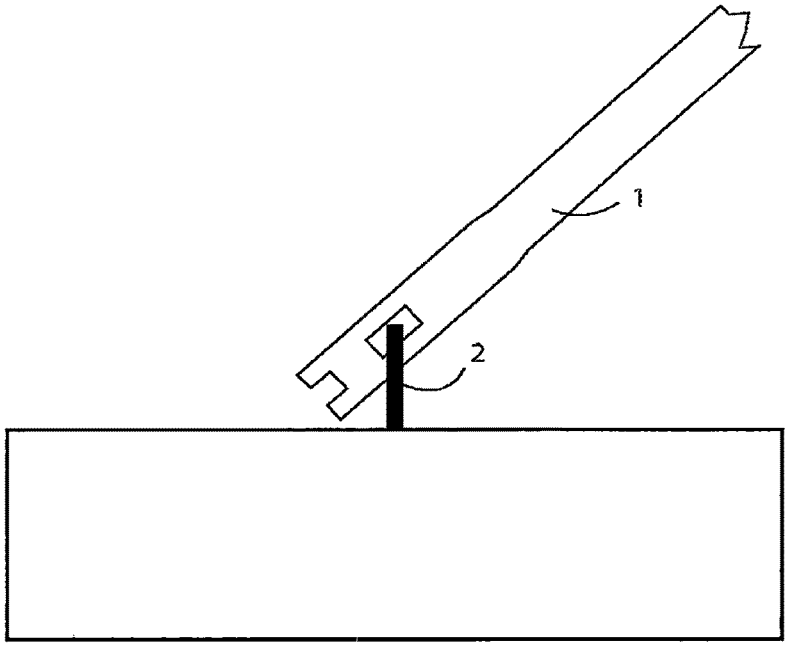
FIG. 1 is a side view of a toy vehicle control mechanism coupled to a toy vehicle. It illustrates a portion of a rod with a longitudinal axis, secured to a connection piece and a toy vehicle. The large rectangle represents a toy vehicle as shown in FIG. 4.
Figure 2:
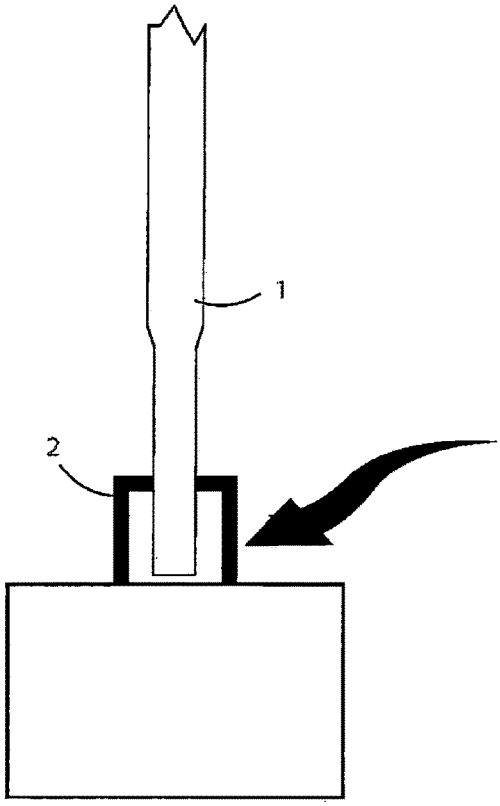
FIG. 2 is an end view of a toy vehicle control mechanism coupled to a toy vehicle. It illustrates a portion of a rod secured to a connection piece and a toy vehicle. The large rectangle represents a toy vehicle as shown in FIG. 4.

Referring to FIG. 1 and FIG. 2, shows an embodiment of a toy vehicle control mechanism for performing stunts. In this embodiment, a rod 1 is secured to a connection piece 2, and the connection piece 2 is connected to a toy vehicle. The shapes of the rod 1 and the connection piece 2 in the drawings are generalized with the predominate use of right angles. Angles may be rounded to adjust performance and looks. The connection piece 2 is the interface between the toy vehicle and the rod 1.

Referring to FIG. 7 through FIG. 12, the rod 1 can maneuver the vehicle about all imaginary axes, as shown in FIG. 5, from a longitudinal to a lateral position of the toy vehicle. Note that the tip of the rod 1 can selectively serve as a pivot point in various manners for such maneuvers, as will be clear in reference to various figures herein.

The rod 1 may be flattened, rounded, or angular. The rod's 1 material, length and thickness could vary depending on the toy vehicle's characteristics, its operating conditions, and user/manufacture preferences. The rod 1 could have varying degrees of flexibility or stiffness depending on the toy vehicle's characteristics, its operating conditions, and user/manufacture preferences. The rod 1 could be molded as one piece or the rod 1 could be telescopic or assembled in pieces to adjust the rod's 1 length preferred by the user or to accommodate manufacturing process and packaging. For example, if the rod 1 is an assembly of pieces, then different rod-tips 3 can be selectively incorporated into the rod 1. The rod 1 could have one or more grips or handles for better control of the toy vehicle. The rod 1 could be translucent or opaque. The rod 1 could be painted or colored, molded with designs or texture, or further customized for visual appearance. The rod 1 could incorporate lighting effects, sound effects, and/or other effects the user can feel through touch; such as vibrations. The rod's shaft 4 and rod-tip 3 could be customized with the addition or upgrade of attachments for increased performance control or visual preference. The rod 1 may have quick-disconnect capability for easy connection and removal from the connection piece 4.

Figures 13, 14:
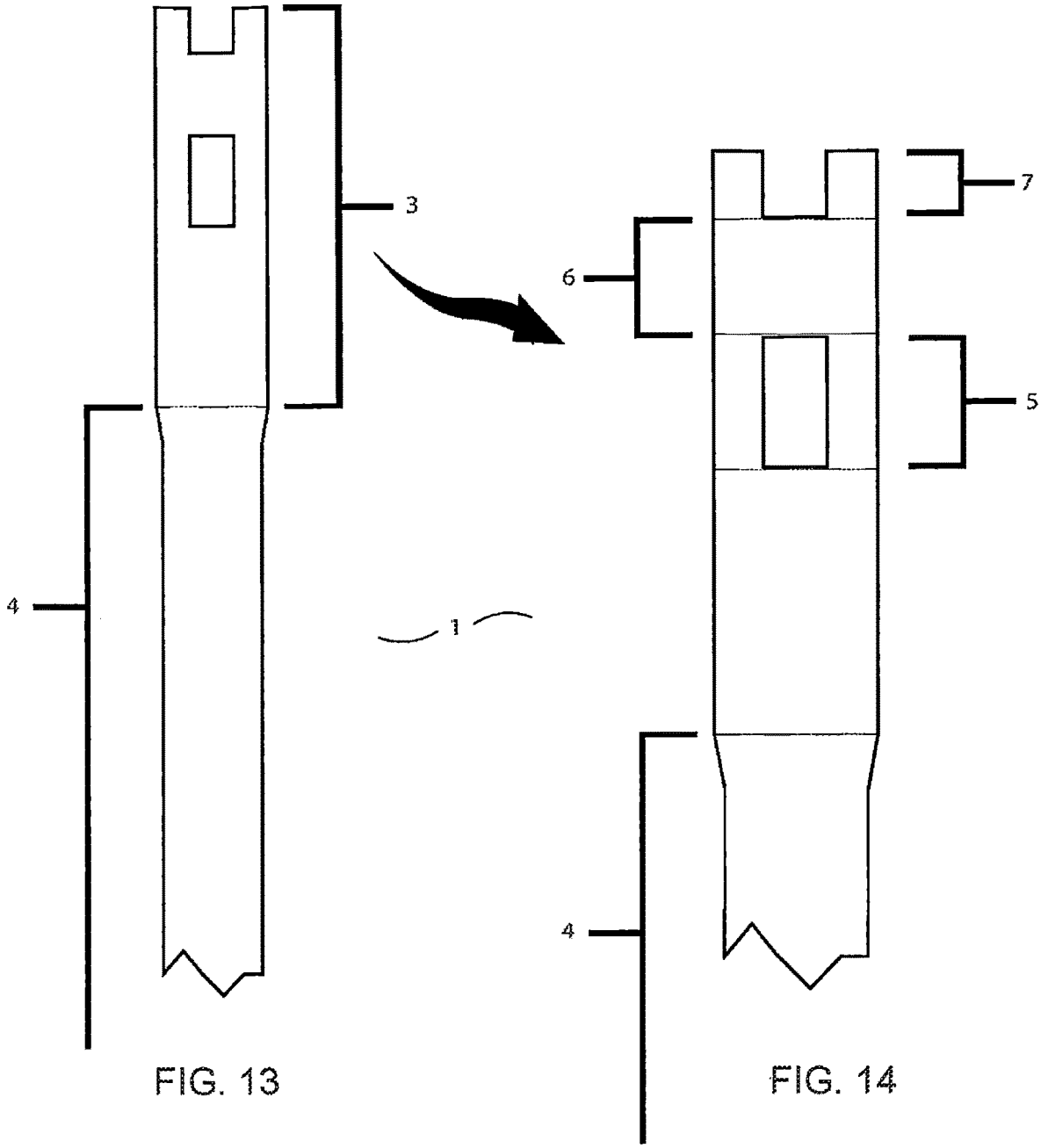
FIG. 13 illustrates a portion of the rod with a longitudinal axis defined by a shaft with a rod-tip.
FIG. 14 illustrates the rod-tip formed to have an interior opening (keeper), an exterior notch (catch) aligned with but distinct from the opening, and a solid section (saddle) separating the notch from the opening.

The rod 1 has a rod-tip 3 and a shaft 4 as illustrated in FIG. 13. The rod tip 3 incorporates a keeper 5, a saddle 6, and a catch 7 as illustrated in FIG. 14. The keeper 5 is an opening within the rod-tip 3 that secures to the connection piece 2. The catch 7 is a notch at the edge of rod-tip 3. The saddle 6 is a section of the rod-tip 3 in between the keeper 5 and the catch 7.

Figure 15:
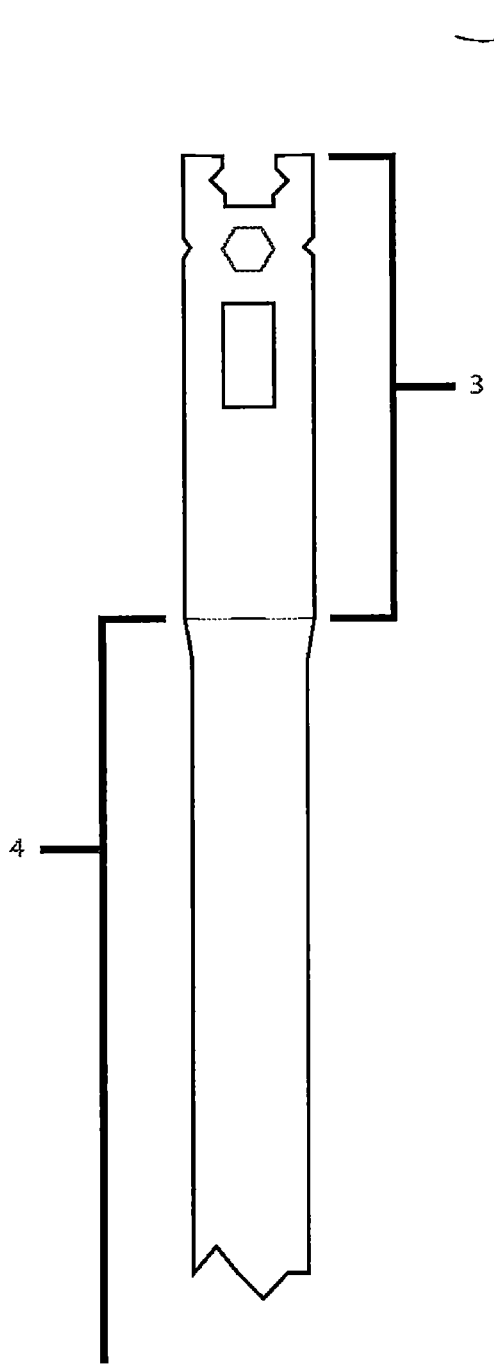
FIG. 15 illustrates an embodiment of a rod-tip with additional notches and openings to provide varied control abilities of a toy vehicle.
Figure 16:
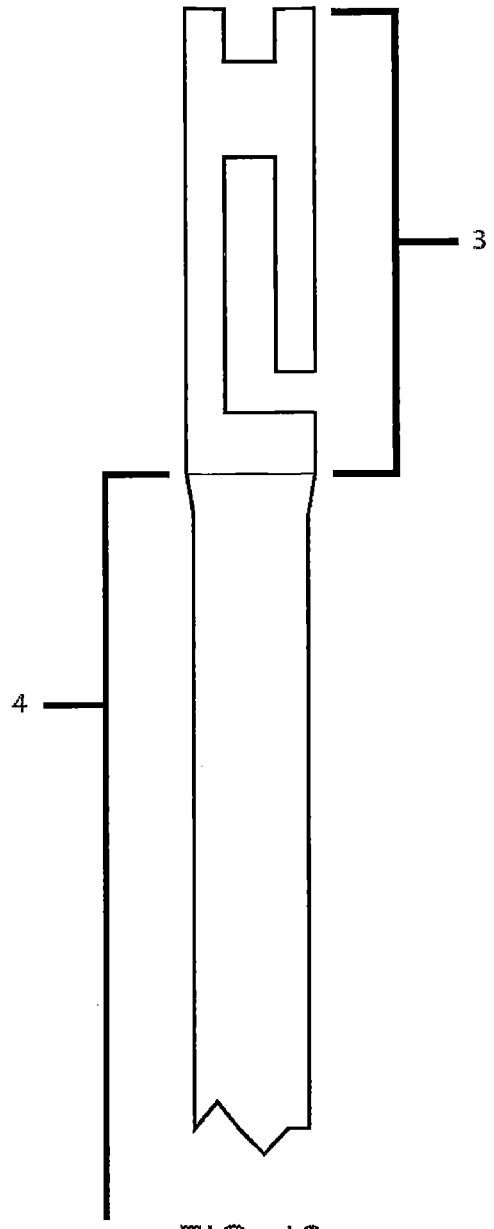
FIG. 16 illustrates an embodiment of a rod-tip that is partially opened that may allow for quick securement to the connection piece.
Figure 17:
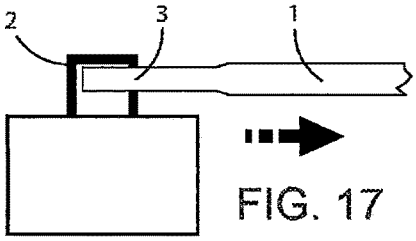
FIG. 17 illustrates an end view of a toy vehicle with the rod-tip disengaged from the connection piece.
Figure 19:
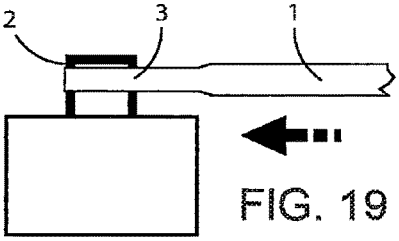
FIG. 19 illustrates an end view of a toy vehicle with the rod-tip engaged to the connection piece.
Figure 18:
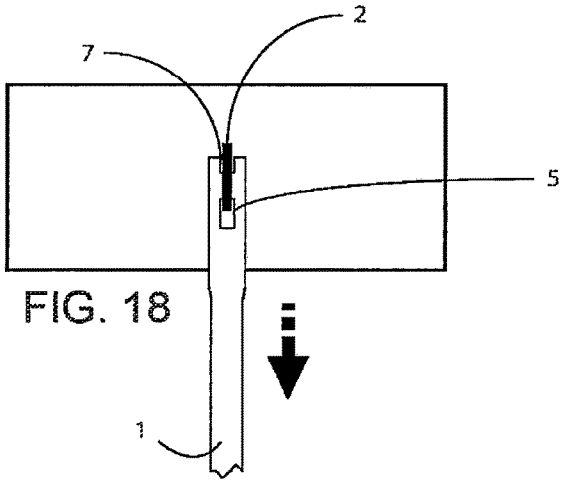
FIG. 18 illustrates the top view of a toy vehicle with the rod-tip disengaged from the connection piece.
Figure 20:
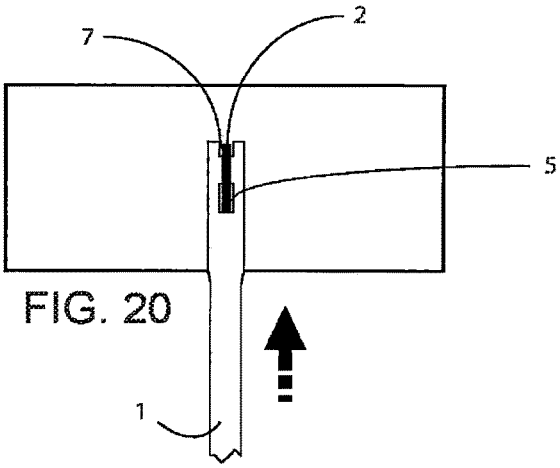
FIG. 20 illustrates the top view of a toy vehicle with the rod-tip engaged to the connection piece.

The rod-tip 3 may be completely molded as one piece from the same material or molded and assembled from a combination of pieces. Additional notches or openings, as illustrated in FIG. 15, may be designed into the rod-tip 3 to provide varied control abilities of a toy vehicle. An opening may be fully enclosed by the rod 1 or partially opened, as illustrated in FIG. 16, for an option of quick securement to a connection piece 2.

Figure 3:
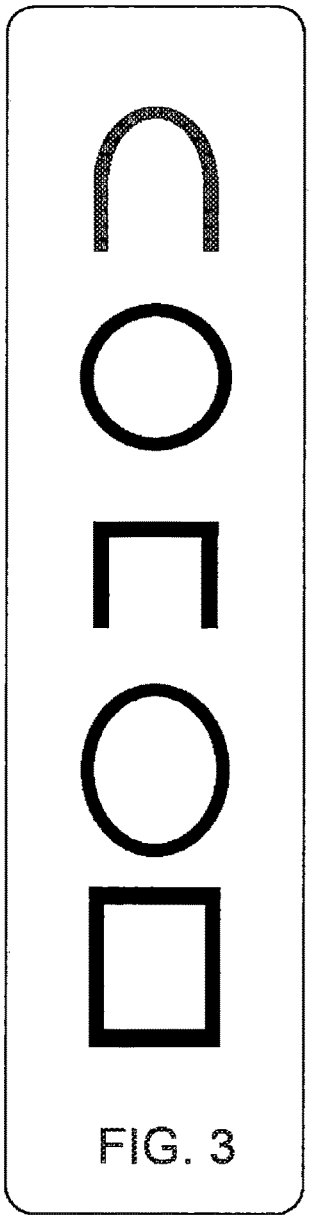
FIG. 3 illustrates some exemplary embodiments for connection piece shapes.

The connection piece 2 can be of any shape formed as a continuous loop or continuous arch shaped structure with at least one curve or one angle located between a first side and a second opposite side. Exemplary embodiments for connection piece 2 shapes include, for example, elliptical or rectangular shaped loops, eyes, or staples, as illustrated in FIG. 3. The shape and size of the connection piece 2. Should allow for its freedom of movement through the keeper 5 while maintaining the capability of positive engagement of the catch 7. Engagement and disengagement of the rod-tip 3 with the connection piece 2 is illustrated in FIG. 17 through FIG. 20.

Figure 21:
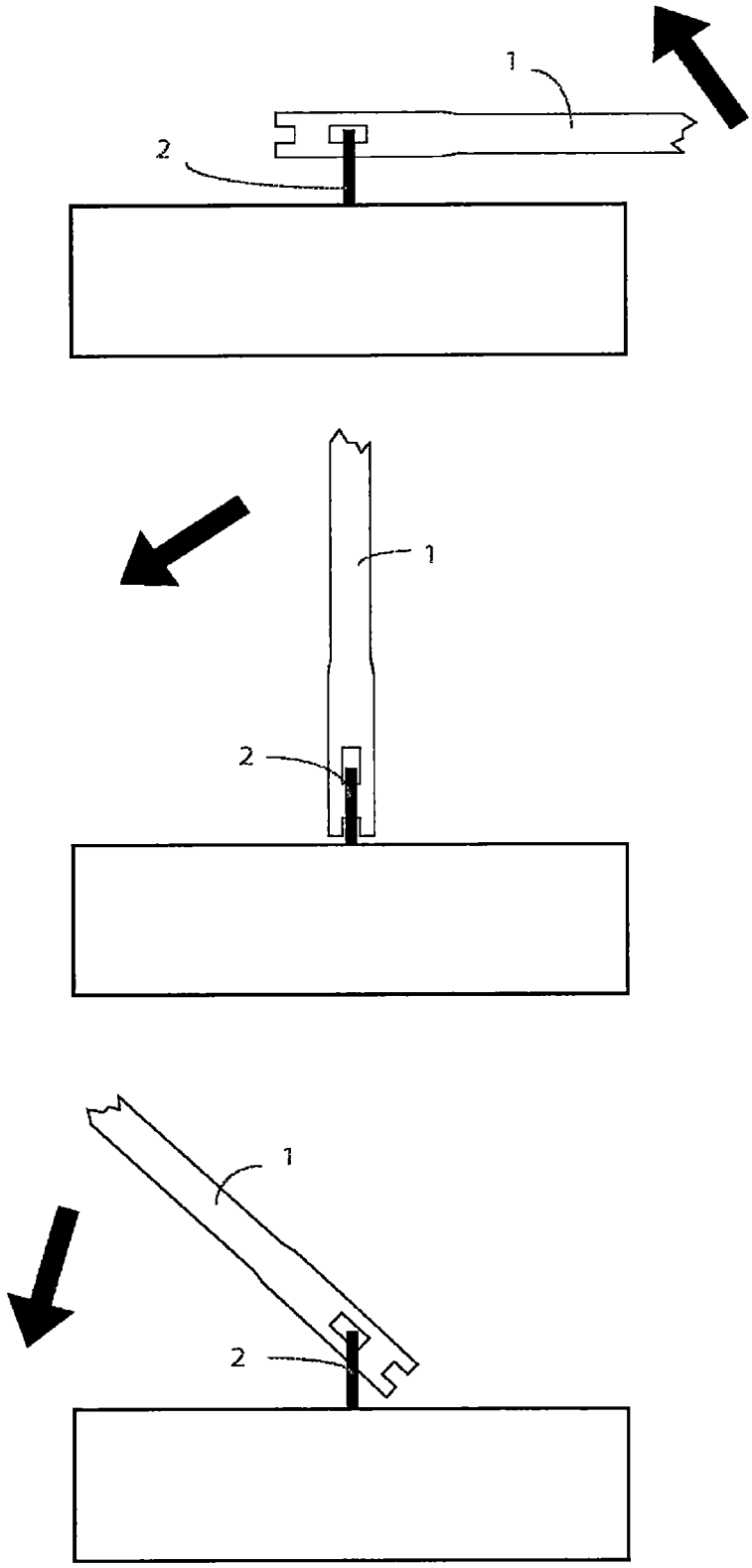
FIG. 21 illustrates a side view of a toy vehicle with the rod rotating about the connection piece in a plane defined by the longitudinal axis of the toy vehicle.
Figure 22:
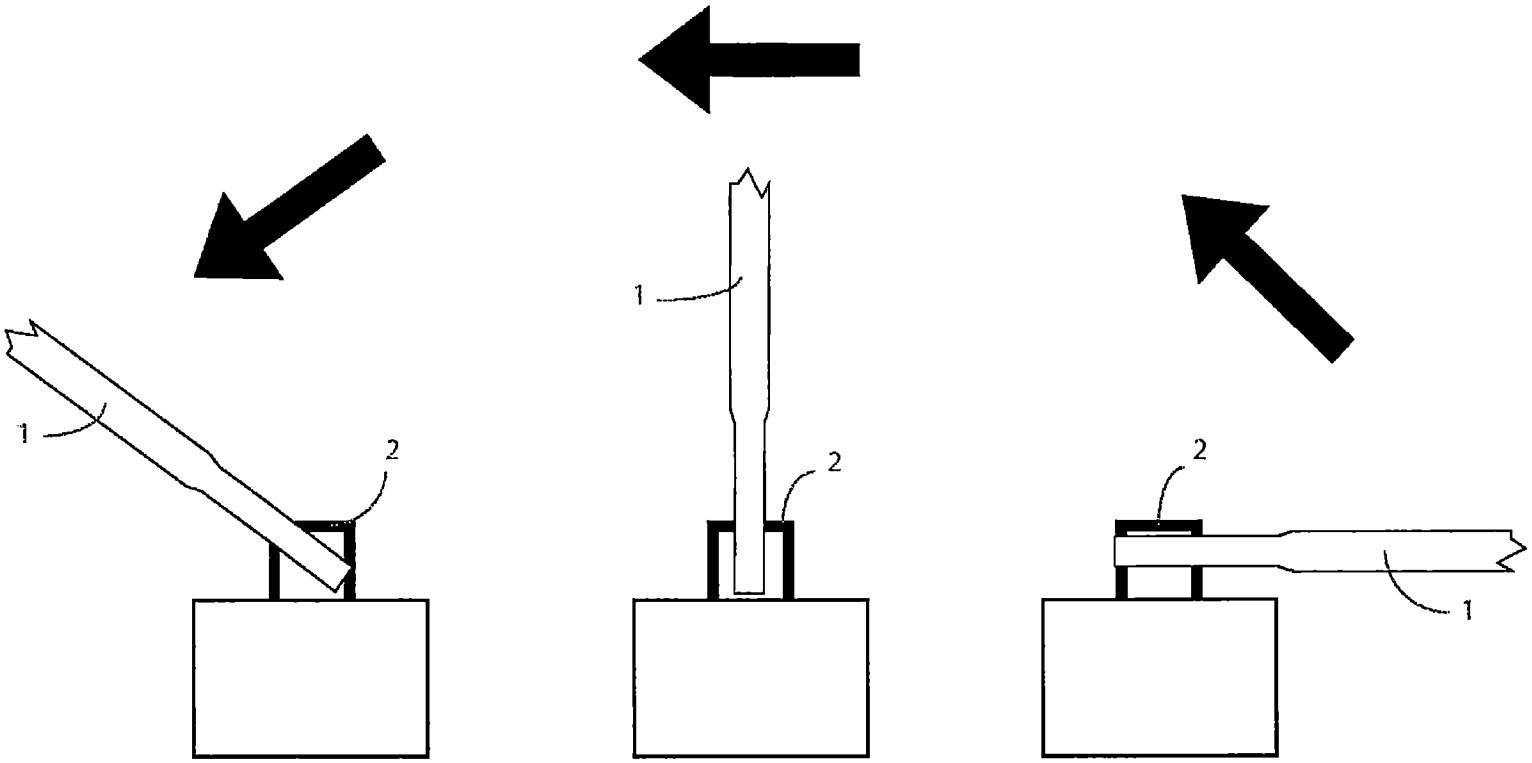
FIG. 22 illustrates an end view of a toy vehicle with the rod traveling along the connection piece from one side to an opposite side, while the longitudinal axis of the rod remains aligned within the plane defined by the connection piece's first side and its second opposite side.

When coupled to the connection piece 2, the rod 1 may be manipulated by the user to selectively perform a plurality of vehicle maneuvers; and when coupled, the rod-tip 3 and connection piece 2 are both configured to permit the rod 1 to be rotated about the connection piece 2 in a plane defined by the longitudinal axis of the toy vehicle, as illustrated in FIG. 21, and permit the rod 1 to travel along the connection piece 2 from one side to the opposite side while the longitudinal axis of the rod 1 remains aligned within the plane defined by the connection piece 2, as illustrated in FIG. 22.

Figure 23:
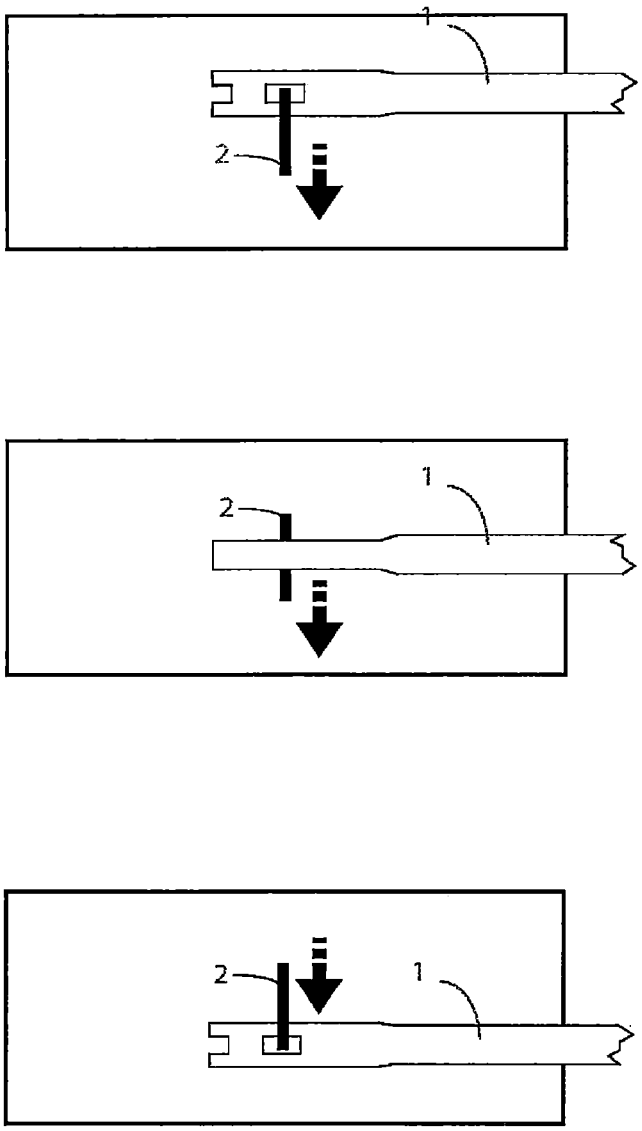
FIG. 23 illustrates a top view of a toy vehicle with the rod traveling along the connection piece from one side to an opposite side while the longitudinal axis of the rod is oriented perpendicular to the plane defined by the connection piece.

When coupled, the rod-tip 3 and connection piece 2 are both configured to permit the rod 1 to travel along the connection piece 2 from one side to the opposite side while the longitudinal axis of the rod 1 is oriented perpendicular to the plane defined by the connection piece 2; as illustrated in FIG. 23.

Figure 25:
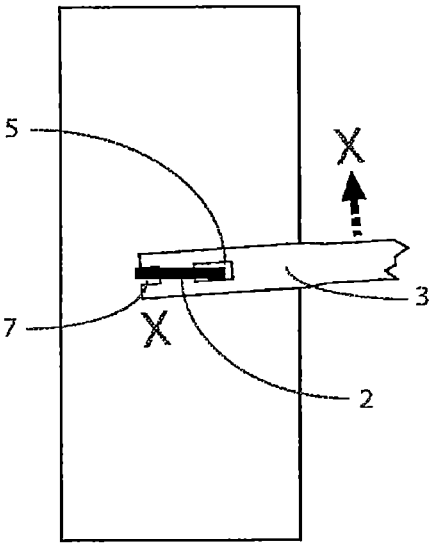
FIG. 25 illustrates the top view of a toy vehicle with the longitudinal axis of the rod being prevented from moving perpendicular or out of alignment with the connection piece due to the rod-tip's notch (catch) engagement to one side of the connection piece.
Figure 27:
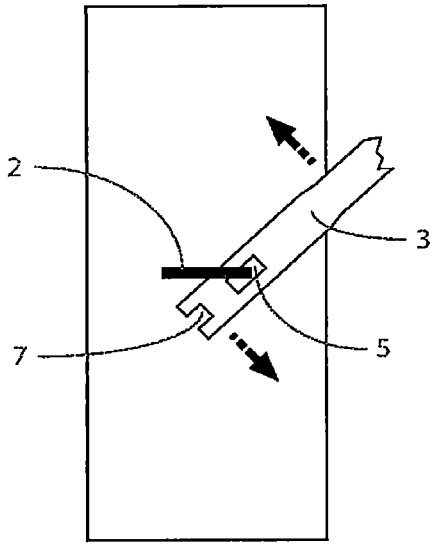
FIG. 27 illustrates the top view of a toy vehicle with the rod-tip's notch (catch) disengaged from the connection piece and the longitudinal axis of the rod moving perpendicular to the plane defined by the connection piece.
Figure 24:
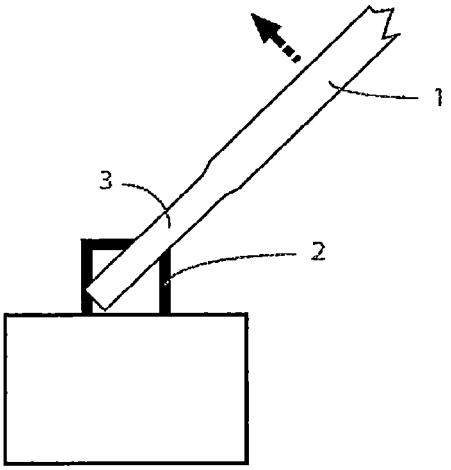
FIG. 24 illustrates an end view of a toy vehicle with the rod-tip engaged with the connection piece and the longitudinal axis of the rod traveling along the plane defined by the connection piece.
Figure 26:
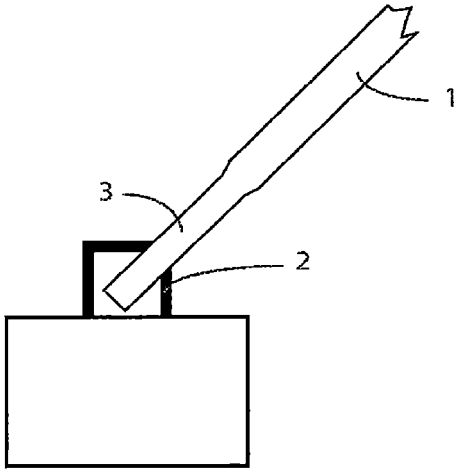
FIG. 26 illustrates an end view of a toy vehicle with the rod at an angle and the rod-tip disengaged with one side of the connection piece.

When the catch 7 is engaged to one side of the connection piece 2 and the keeper 5 is surrounding a portion of the connection piece 2 on the opposite side, as illustrated in FIG. 24 and FIG. 25, the longitudinal axis of the rod 1 will be prevented from moving perpendicular or out of alignment with the plane defined by the connection piece 2. The rod 1 may travel perpendicular or out of alignment with the connection piece 2 once the catch 7 is disengaged with one side of the connection piece 2, as shown in FIG. 26 and FIG. 27.

Figure 28:
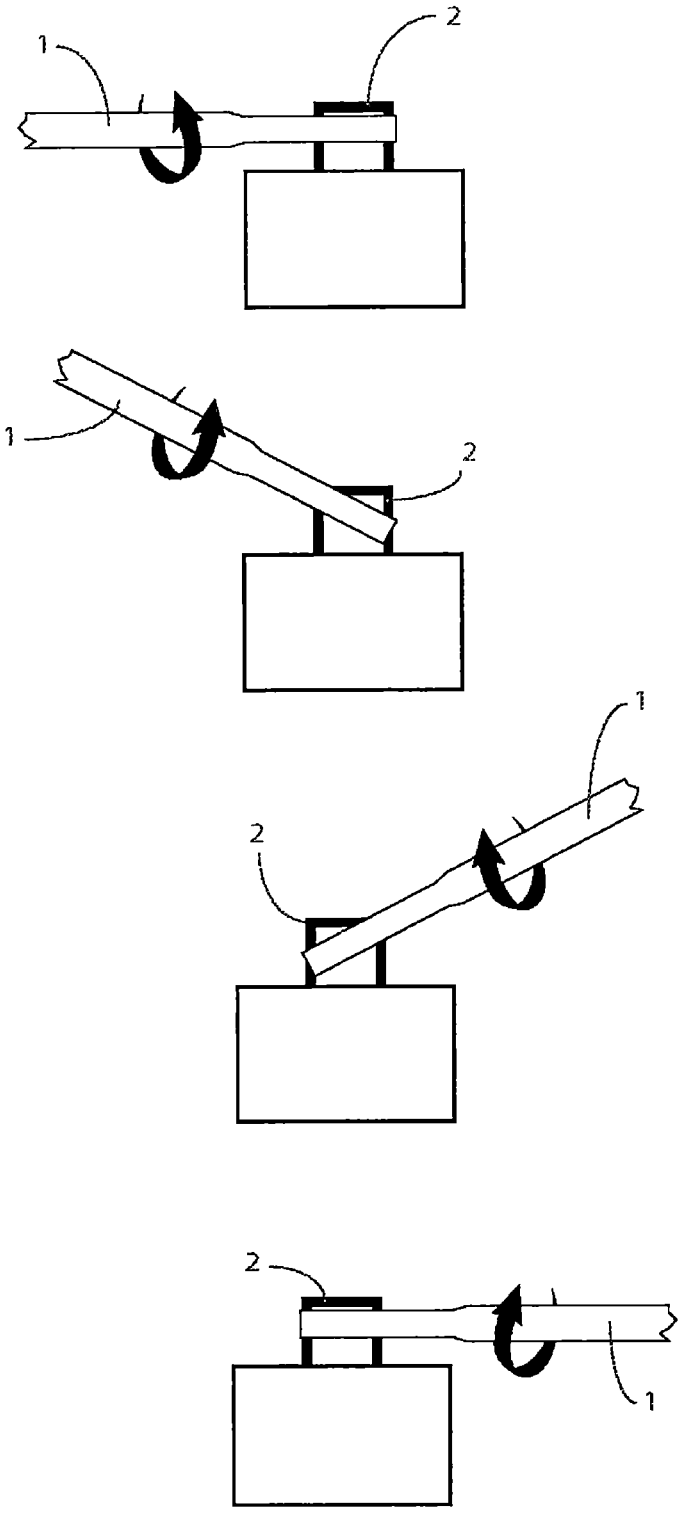
FIG. 28 shows an end view of a toy vehicle and illustrates the manipulation of a toy vehicle can be accomplished from varying angles with the rod's engagement to the connection piece.
Figure 30:
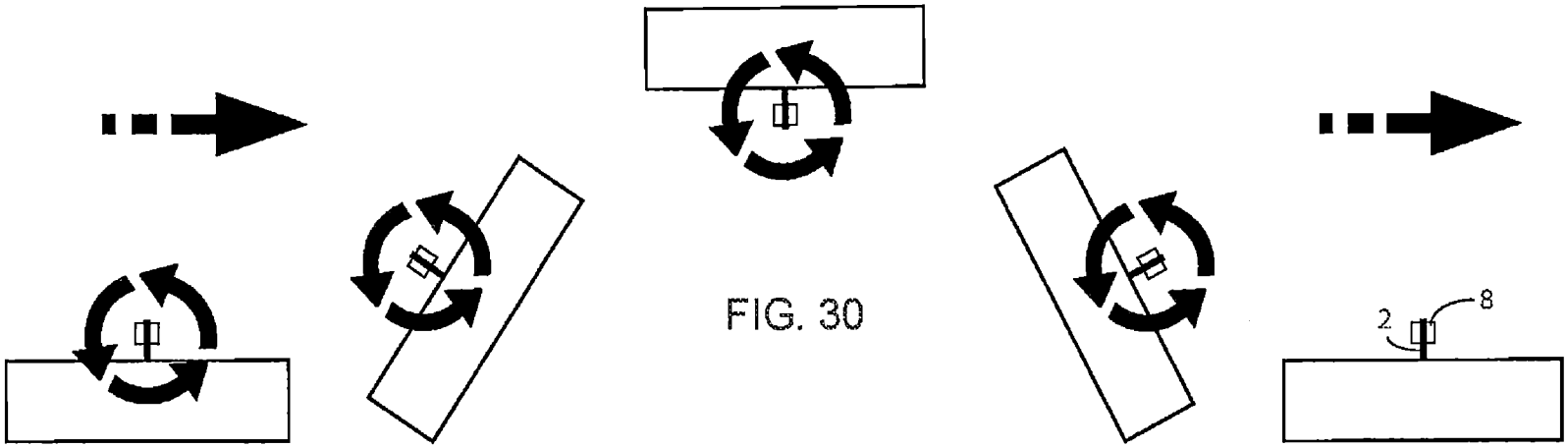
FIG. 30 illustrates a side view of a propelled toy vehicle being flipped while the rod is engaged to the connection piece and the rod is being twisted.
Figure 29:
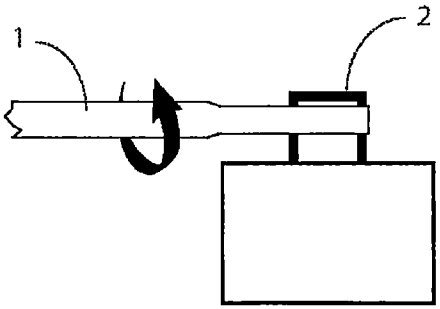
FIG. 29 illustrates an end view of a toy vehicle and the rod being twisted while engaged to the connection piece.

Additionally, the keeper 5, saddle 6, catch 7, and connection piece 2 should be configured to allow for the rod-tip 3 to engage with the connection piece 2 and twist from various angles of the rod 1, as illustrated in FIG. 28, while also allowing for the toy vehicle to pitch or rotate about the vehicle's lateral axis, as illustrated in FIG. 29 and FIG. 30.

The connection piece 2 comprises of one or more mounting points to the toy vehicle and/or associated accessories. The connection piece 2 may be attached to the toy vehicle and/or associated accessories through a plurality of means desired by the manufacturer. The connection piece 2 may have quick-disconnect capability for easy removal from the toy vehicle. For example, the connection piece 2 can be formed from a spring-loaded material and shaped such that compressing the two ends of the connection piece 2 permits the connection piece to be locked into or unlocked from an appropriately-shaped cavity formed in the toy vehicle. The connection piece's 2 material, size, and texture could vary depending on the rod 1 and vehicle's size and characteristics, its operating conditions, and user/manufacture preferences. An exemplary preferred embodiment includes the use of raised ridges along the surface of the connection piece 2. A textured surface of the connection piece 2 can assist the rod-tip 3 in grasping the connection piece 2.

With the control mechanism coupled to a toy vehicle, stunts and other maneuvers may be simulated by propelling the vehicle in a desired direction by pushing, pulling, or twisting the rod 1. This control mechanism allows a user to rotate a toy vehicle about an axis, as shown in FIG. 5, and also hold the vehicle at a fixed position on that axis if desired.

Twisting the rod 1 exerts axial forces onto the connection piece 2 by way of the inner surfaces of the catch 7 and/or keeper 5, making contact with the surfaces of the connection piece 2, and, depending on the position of the rod 1 in relation to the connection piece 2, will cause the vehicle to yaw, pitch, and/or roll.

Figure 31:
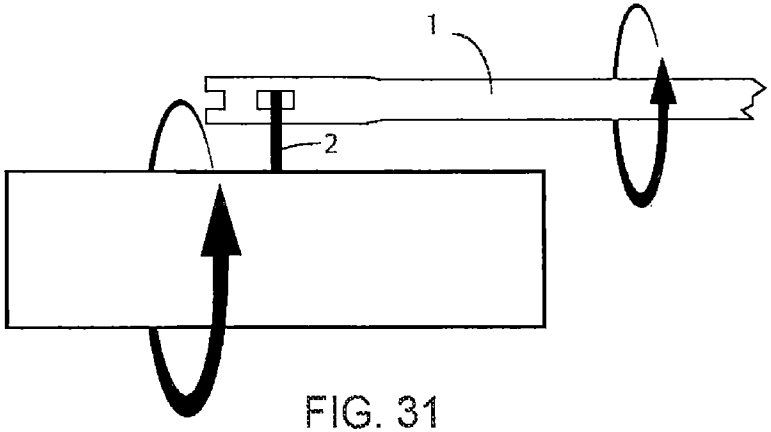
FIG. 31 illustrates a side view of a toy vehicle rolling about its longitudinal axis as the rod is being twisted.
Figure 32:
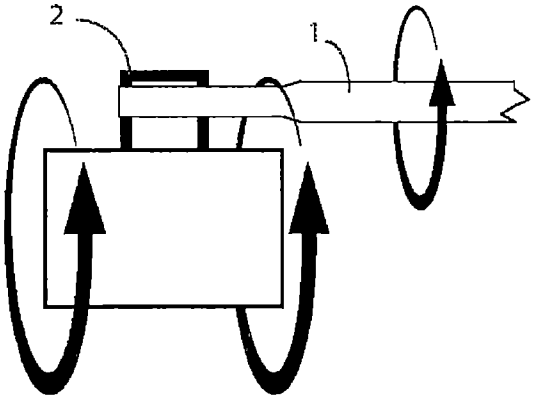
FIG. 32 illustrates an end view of a toy vehicle pitching about its lateral axis as the rod is being twisted.
Figure 33:
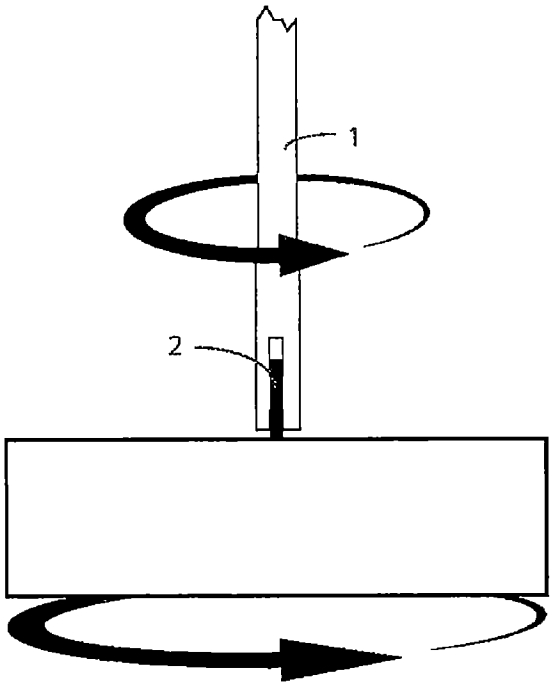
FIG. 33 illustrates a side view of a toy vehicle yawing about its vertical axis as the rod is being twisted.
Figure 34:
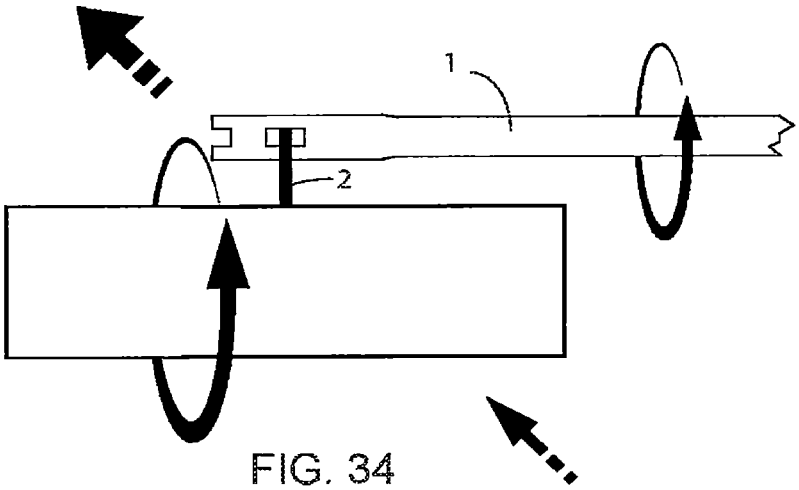
FIG. 34 illustrates a side view of a toy vehicle rolling about its longitudinal axis while being lifted or suspended in the air as the rod is being twisted.
Figure 35:
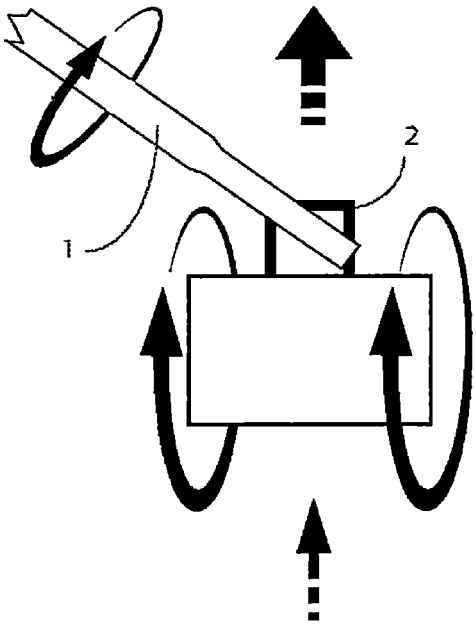
FIG. 35 illustrates an end view of a toy vehicle pitching about its lateral axis while being lifted or suspended in the air as the rod is being twisted from an angle.
Figure 36:
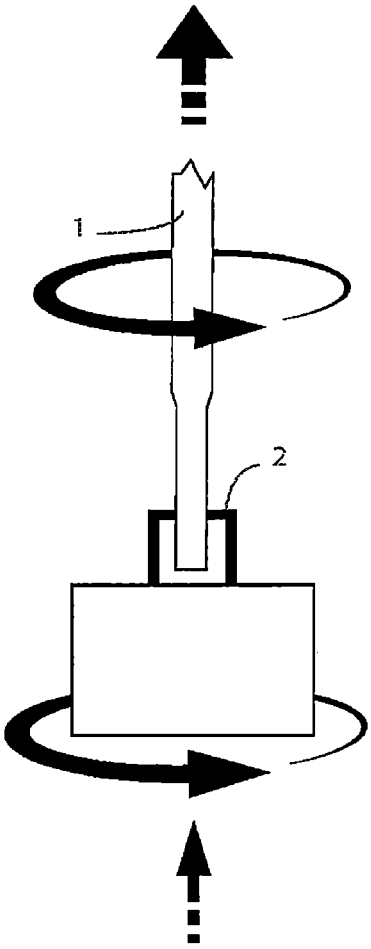
FIG. 36 illustrates an end view of a toy vehicle yawing about its vertical axis while being lifted or suspended in the air as the rod is being twisted.

For example, to make the vehicle roll, the rod 1 could be twisted about the longitudinal axis of the toy vehicle, as shown in FIG. 31. To make the vehicle pitch, the rod 1 could be twisted about the lateral axis of the toy vehicle, as shown in FIG. 32. To make the vehicle yaw, the rod 1 could be twisted about the vertical axis of the toy vehicle, as shown in FIG. 33. Additionally, a toy vehicle could also perform aerial maneuvers by twisting the rod 1 about an axis while being lifted or suspended in the air, as shown in FIG. 34 through 36.

Figure 38:
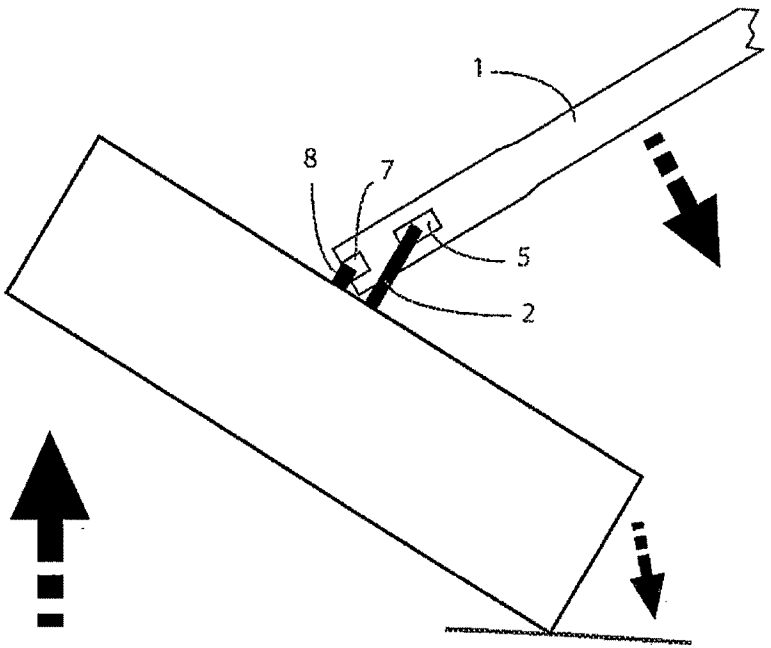
FIG. 38 illustrates a side view of a toy vehicle pitching upwards about its lateral axis with the rod in a longitudinal position relative to the vehicle.
Figure 37:
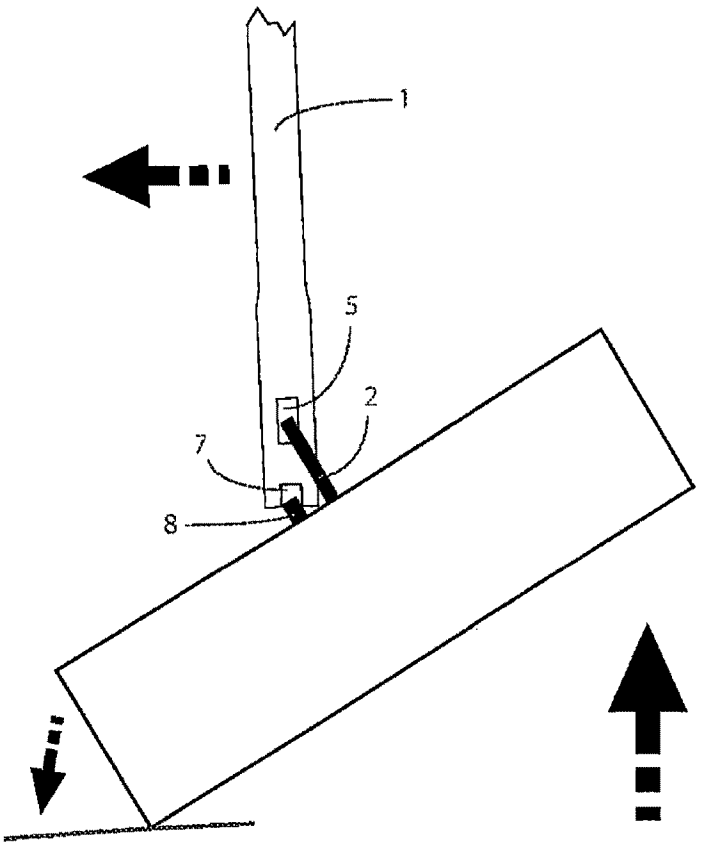
FIG. 37 illustrates a side view of a toy vehicle pitching downwards about its lateral axis with the rod in a longitudinal position relative to the vehicle.

Referring to FIG. 37 and FIG. 38, one or more pivot devices 8 may be added to a toy vehicle or associated accessories for the catch 7 to engage with, for additional performance. Pushing or pulling the rod 1 in this configuration will exert axial forces onto the pivot device 8 and connection piece 2 by way of the inner surfaces of the catch 7 and keeper 5 contacting the surfaces of the pivot device 8 and connection piece 2. In this exemplary embodiment, the rod-tip 3 is engaged with a pivot device 8 on the toy vehicle, allowing for a user to move the toy vehicle about the lateral axis and make the vehicle pitch up or down by pushing or pulling the rod 1 with the rod 1 in a longitudinal position relative to the vehicle.

Figure 39:
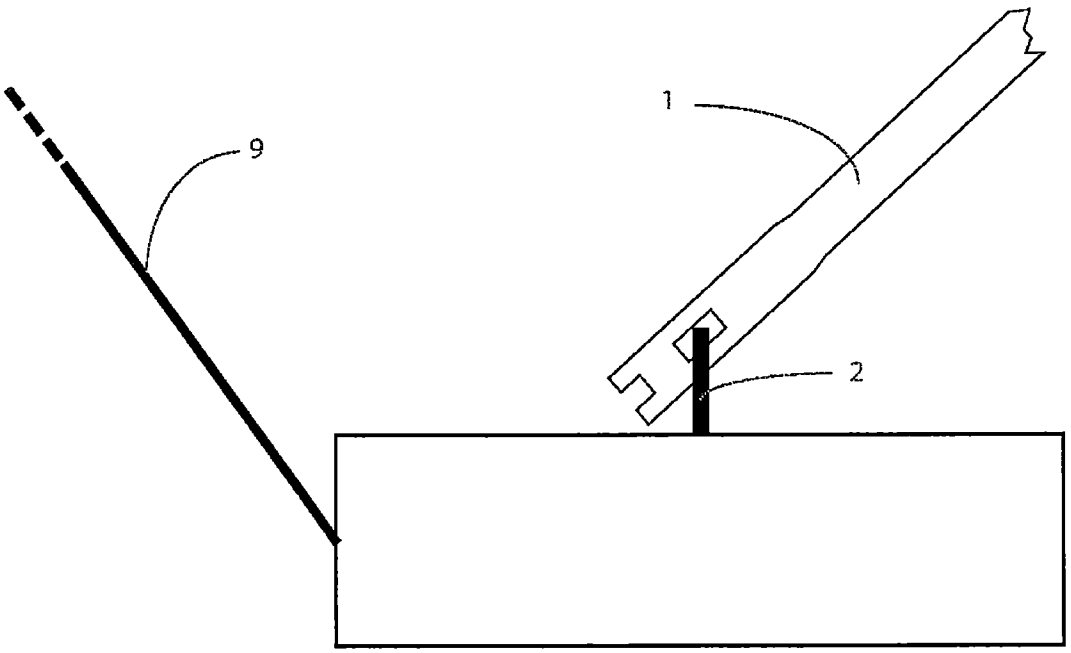
FIG. 39 illustrates a side view of a toy vehicle and the utilization of a supplemental device tethered to one end of the toy vehicle.

To complement the toy vehicle control mechanism and to further improve the performance of a toy vehicle, one or more supplemental devices 9, including, for example, lines, strings, sticks, poles, or wands, may be tethered to one or more desired locations on the vehicle, as shown in FIG. 39. The supplemental tethered device(s) 9 may act as a stabilizer for greater control when performing maneuvers with the toy vehicle.

Figure 40:
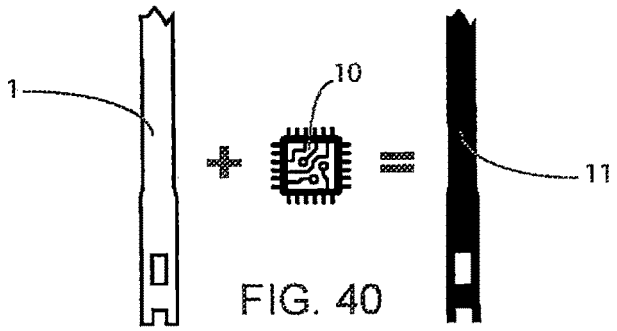
FIG. 40 illustrates a rod combined with computer circuitry is a smart-rod. The smart-rod is the rod shaded in black.
Figure 41:
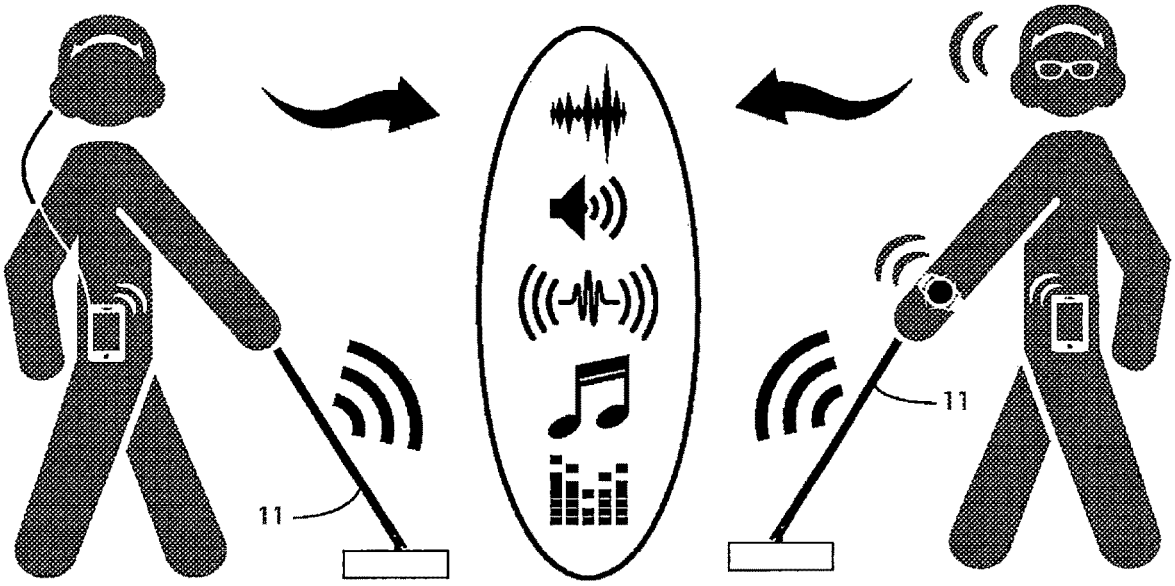
FIG. 41, shows users controlling vehicles with smart-rods, and illustrates that a smart-rod and other devices with wireless short-range interconnection technology could incorporate effects to enhance the play situation and the user's experience.
Figure 42:
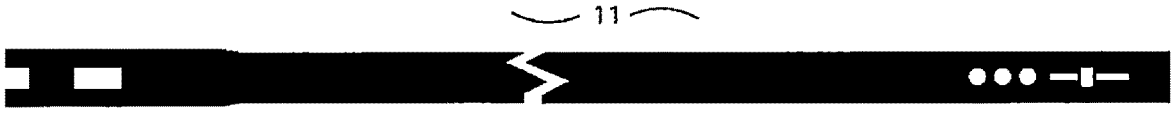
FIG. 42 illustrates an example of a smart-rod with sensors that may be used to generate vehicle sounds or other special effects.

In an exemplary embodiment, the rod 1 can incorporate one or more electronic circuits 10, including, for example, computer circuitry, to become a smart-rod 11, as shown in FIG. 40. The smart-rod 11 may, for example, include one or more microchips that would be capable of transmitting and/or receiving information wirelessly using wireless short-range interconnection technology, as shown in FIG. 41. The smart-rod 11 could also have the capability to transmit and/or receive information through a wired connection. The smart-rod 11 could include a feature where the user can manipulate a sensor or multiple sensors (incorporated with the smart-rod 11), as shown in FIG. 41 to generate vehicle sounds or other effects, as shown in FIG. 41. A sensor could also be manipulated to activate various functions or capabilities of the toy vehicle, if the toy vehicle has been provided with built-in modules permitting such functions or capabilities to be electronically controlled. The smart-rod 11 along with a toy vehicle could also incorporate various movement-type sensors to detect motion and/or position of the smart-rod 11 and/or vehicle. Such capability might be useful, for example, to permit a user's motions of the smart-rod 11 or the vehicle to be sensed and transmitted to an associated device, such as a computer or smart phone, for analysis of the user's performance in executing maneuvers or tricks. Additional computer circuitry and sensors may be added to smart-rods 11 and/or toy vehicles to expand their functionality.

For example, using wireless short-range interconnection technology, as shown in FIG. 41, a network could be established between the smart-rod 11 and the user's smartphone, smartwatch, and/or earphones to enhance the user's experience by incorporating various possible effects. These effects could include, but are not limited to: sound effects, visual effects, music, and/or other effects such as vibrations. These effects could emanate from smart-rods 11, toy vehicles, and other smart devices. These effects could correspond from various inputs from a user's manipulation of a smart-rod 11 sensor or from the motion or position of the smart-rod 11, toy vehicles, or other devices in the play situation. Using wireless short-range interconnection technology, the toy vehicles or any other device that may accompany the play situation could also include microchips and/or other computer circuitry that would form a network to transmit and/or receive information between the smart-rods 11 and/or other devices in the play situation. Devices including cell phones, smartphones, and computers may also accompany the network in the play situation. To complement the applied short-range interconnection technology, any mobile smart device including, for example, smartphones/tablets, smartwatches, or smart-glasses may incorporate a software application designed to interact with the user, the rod 1 or smart-rod 11, the toy vehicle, and/or other devices that may accompany the play situation. It is noted that wireless short-range interconnection technology relates to wireless communication between two or more electronic devices. Additionally, a smart device can include an electronic device, generally connected to other devices or networks via different wireless protocols that can operate to some extent interactively and autonomously.

That which is claimed is:

1. A toy vehicle control mechanism for performing stunts, the control mechanism comprising:

a rod with a longitudinal axis defined by a shaft with a rod-tip, wherein the rod-tip is formed to have an interior opening, an exterior notch aligned with but distinct from the opening, and a solid section separating the notch from the opening;

a connection piece formed as a continuous loop or continuous arch shaped structure with at least one curve or one angle located between a first side and a second opposite side;

wherein the connection piece is secured to a toy vehicle such that a plane defined by the connection piece is perpendicular to a longitudinal axis of the toy vehicle to act as an interface between the toy vehicle and the rod-tip when the connection piece is coupled to the rod-tip by positioning the connection piece within the opening to allow a user to selectively manipulate the toy vehicle using the rod; and when coupled the rod-tip and connection piece are both configured to:

prevent the longitudinal axis of the rod from being moved out of alignment with the plane defined by the connection piece when the notch engages a portion of the connection piece on the first side of the connection piece and the opening surrounds a portion of the connection piece on the second side of the connection piece;

permit the rod to travel along the connection piece from the first side to the second side while the longitudinal axis of the rod remains aligned within the plane defined by the connection piece;

permit the rod to travel along the connection piece from the first side to the second side while the longitudinal axis of the rod is oriented perpendicular to the plane defined by the connection piece; and permit the rod to be rotated about the connection piece in a plane defined by the longitudinal axis of the toy vehicle.

2. A toy vehicle control mechanism of claim 1, wherein the rod-tip has a capability to be selectively connected and disconnected from the connection piece.

3. A toy vehicle control mechanism of claim 1, wherein the connection piece has a capability to be selectively connected and disconnected from a toy vehicle.

4. A toy vehicle control mechanism of claim 1, wherein the rod is telescopic to selectively permit an adjustment of a length of the rod.

5. A toy vehicle control mechanism of claim 1, wherein the rod comprises an assembly of pieces.

6. A toy vehicle control mechanism of claim 1, wherein the rod is molded from one piece.

7. A toy vehicle control mechanism of claim 1, wherein the rod-shaft comprises one or more grips or handles.

8. A toy vehicle control mechanism of claim 1, wherein the rod incorporates one or more microchips.

9. A toy vehicle control mechanism of claim 8, wherein the rod thereby incorporates special effects including any of sound effects, visual effects, music, and vibrations.

10. A toy vehicle control mechanism of claim 8, wherein the rod is capable of transmitting and/or receiving information wirelessly.

11. A toy vehicle control mechanism of claim 8, wherein the rod is capable of transmitting and/or receiving information through a wired connection.

12. A toy vehicle control mechanism of claim 8, wherein the rod incorporates one or more sensors that can be manipulated by the user to generate special effects and/or activate various functions or capabilities of the toy vehicle and/or the rod.

13. A toy vehicle control mechanism of claim 8, wherein the rod incorporates one or more sensors that can detect motion and/or position, to selectively generate special effects and/or activate various functions or capabilities of the toy vehicle and/or the rod.

14. A toy vehicle control mechanism of claim 1, wherein the connection piece has a textured surface.

* * * * *